United States Patent [19]

Münzel

[11] 4,455,939

[45] Jun. 26, 1984

[54] IMPACT FUZE WITH FLIGHT TIME-DEPENDENT DETONATION DELAY

[75] Inventor: Klaus Münzel, Klingnau, Switzerland

[73] Assignee: Werkzeugmaschinenfabrik Oerlikon-Bührle AG, Zürich, Switzerland

[21] Appl. No.: 340,488

[22] Filed: Jan. 18, 1982

[30] Foreign Application Priority Data

Jan. 30, 1981 [CH] Switzerland ..... 683/81

[51] Int. Cl.[3] ..... F42C 11/06

[52] U.S. Cl. ..... 102/215

[58] Field of Search ..... 102/215, 216, 206, 266

[56] References Cited

U.S. PATENT DOCUMENTS

| | | | |
|---|---|---|---|
| 3,622,987 | 11/1971 | Borkan . | |
| 3,853,063 | 12/1974 | Hoyt et al. | 102/215 |
| 3,967,554 | 7/1976 | Troyer, Jr. . | |
| 4,240,350 | 12/1980 | Münzel et al. | 102/215 |
| 4,387,649 | 6/1983 | Weidner et al. | 102/215 |

FOREIGN PATENT DOCUMENTS

| | | |
|---|---|---|
| 2210277 | 9/1972 | Fed. Rep. of Germany . |
| 2152427 | 2/1977 | Fed. Rep. of Germany . |
| 608604 | 1/1979 | Switzerland . |

*Primary Examiner*—Charles T. Jordan

*Attorney, Agent, or Firm*—Werner W. Kleeman

[57] ABSTRACT

An impact fuze with a time-delay between the impact of a flying object, such as a rocket or projectile at the target and the detonation thereof renders possible the penetration of the rocket or projectile into the target before the detonation. The flight velocity or speed of a projectile decreases with increasing flying time. In order to ensure for a penetration depth which nevertheless is sufficient, the impact time-delay must increase with decreasing flight velocity of the rocket or projectile. For this purpose, a time-delay counter is set by means of a self-destruction counter as a function of the flight velocity.

3 Claims, 4 Drawing Figures

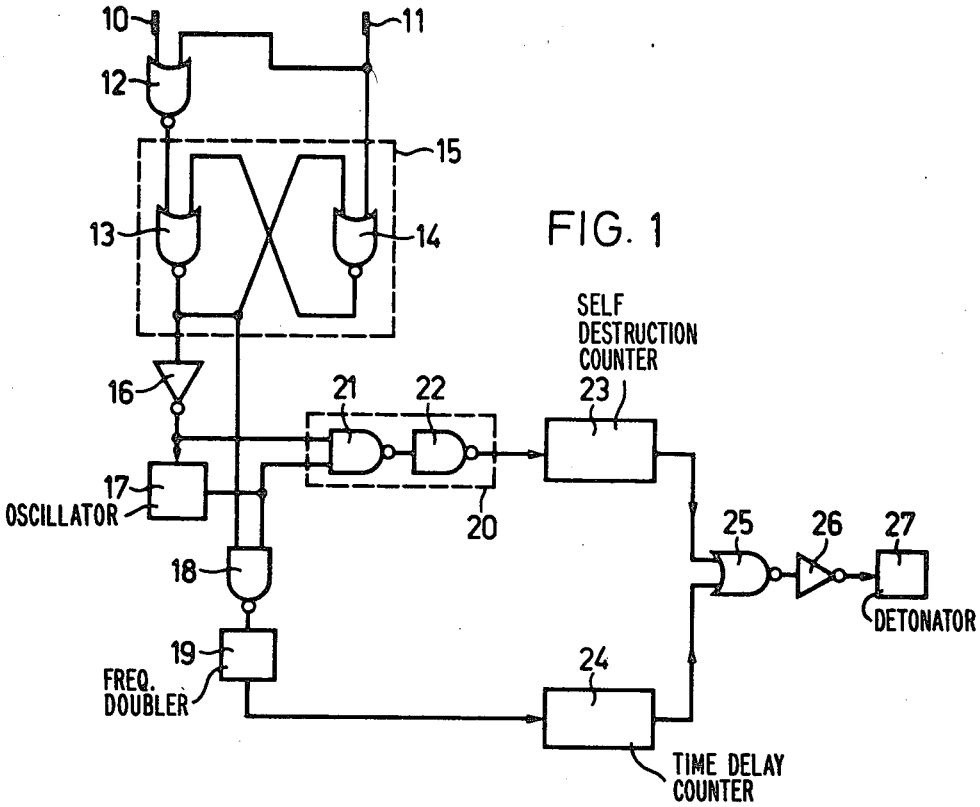
FIG. 1
FIG. 3
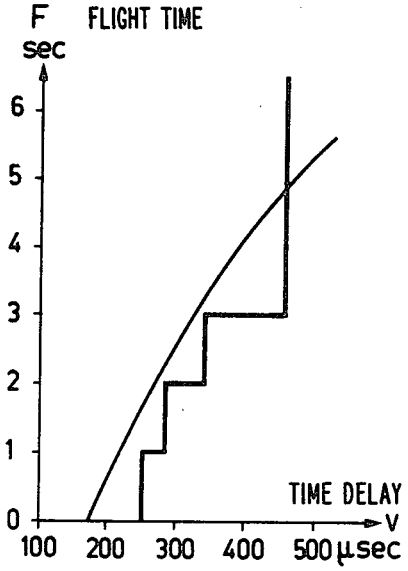
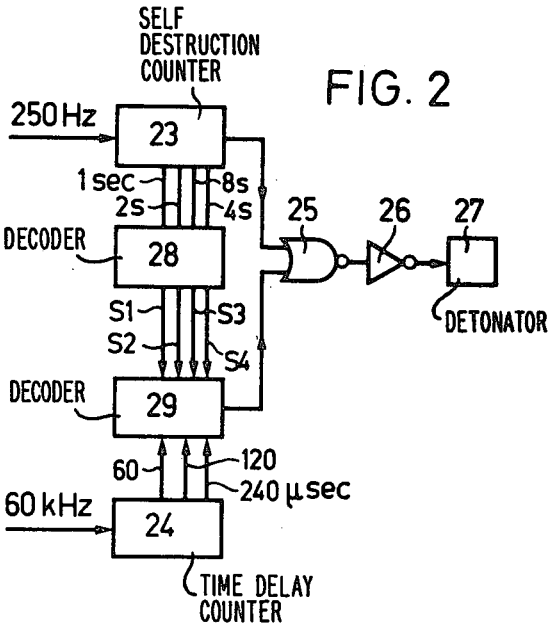
FIG. 2

IMPACT FUZE WITH FLIGHT TIME-DEPENDENT DETONATION DELAY

BACKGROUND OF THE INVENTION

The present invention relates to a new and improved construction of impact fuze for airborne or flying objects, especially for rockets or projectiles and having a flight time-dependent time-delay between the moment of impact and the detonation of the rocket or projectile at the target.

Generally speaking, the inventive impact fuze comprises elements for measuring the flight time, elements for measuring the time-delay, and elements for setting or adjusting the time-delay as a function of the flight time of the rocket or projectile.

With a known impact fuze of this type, as disclosed in German patent publication No. 2,152,427, the detonation time-delay from the moment of impact directly depends upon the difference between charges of two capacitors. The first capacitor essentially maintains the initial charge it was given prior to launching the projectile, while the charge given to the second capacitor prior to the projectile launching is successively reduced with increasing flight time. When the impact switch is closed, the first capacitor is discharged in a defined manner by means of a resistor. The detonation occurs at a given voltage relationship between the two capacitors, preferably at equal voltage.

This prior art impact fuze has the disadvantage of containing capacitors, which impair the reliability and precision of the fuze.

SUMMARY OF THE INVENTION

Hence, it is an important object of the present invention to provide a new and improved construction of impact fuze which is not afflicted with the aforementioned drawbacks and limitations of the prior art.

Another significant object of the present invention aims at providing a new and improved construction of combined impact and time fuze which is extremely reliable and accurate in its operation.

Still a further important object of the present invention is to provide a new and improved construction of combined impact and time fuze, wherein the impact fuze works with flight time-dependent time-delay, without requiring additional capacitors or other passive electronic elements.

Now in order to implement these objects and others which will become more readily apparent as the description proceeds, the impact fuze according to the present invention is manifested by the features that it comprises:

a first counter for determining the flight time;

a second counter for determining the time-delay; and a circuit for switching over in steps the second counter to a greater time-delay as a function of the increasing flight time which is determined by the first counter.

BRIEF DESCRIPTION OF THE DRAWINGS

The invention will be better understood and objects other than those set forth above will become apparent when consideration is given to the following detailed description thereof. Such description makes reference to the annexed drawings which illustrate an exemplary embodiment of the present invention and wherein:

FIG. 1 is a block circuit diagram of a conventional impact fuze which is provided with an adjustable impact time-delay;

FIG. 2 is a block circuit diagram of an impact fuze according to the invention, which contains a selfdestruction counter and a delay counter;

FIG. 3 is a diagram which illustrates the required time-delay for the detonation of the rocket or projectile after its impact upon the target, wherein this time-delay is a function of the flight time of the rocket or projectile.

DETAILED DESCRIPTION OF THE PREFERRED EMBODIMENTS

Figure 4:
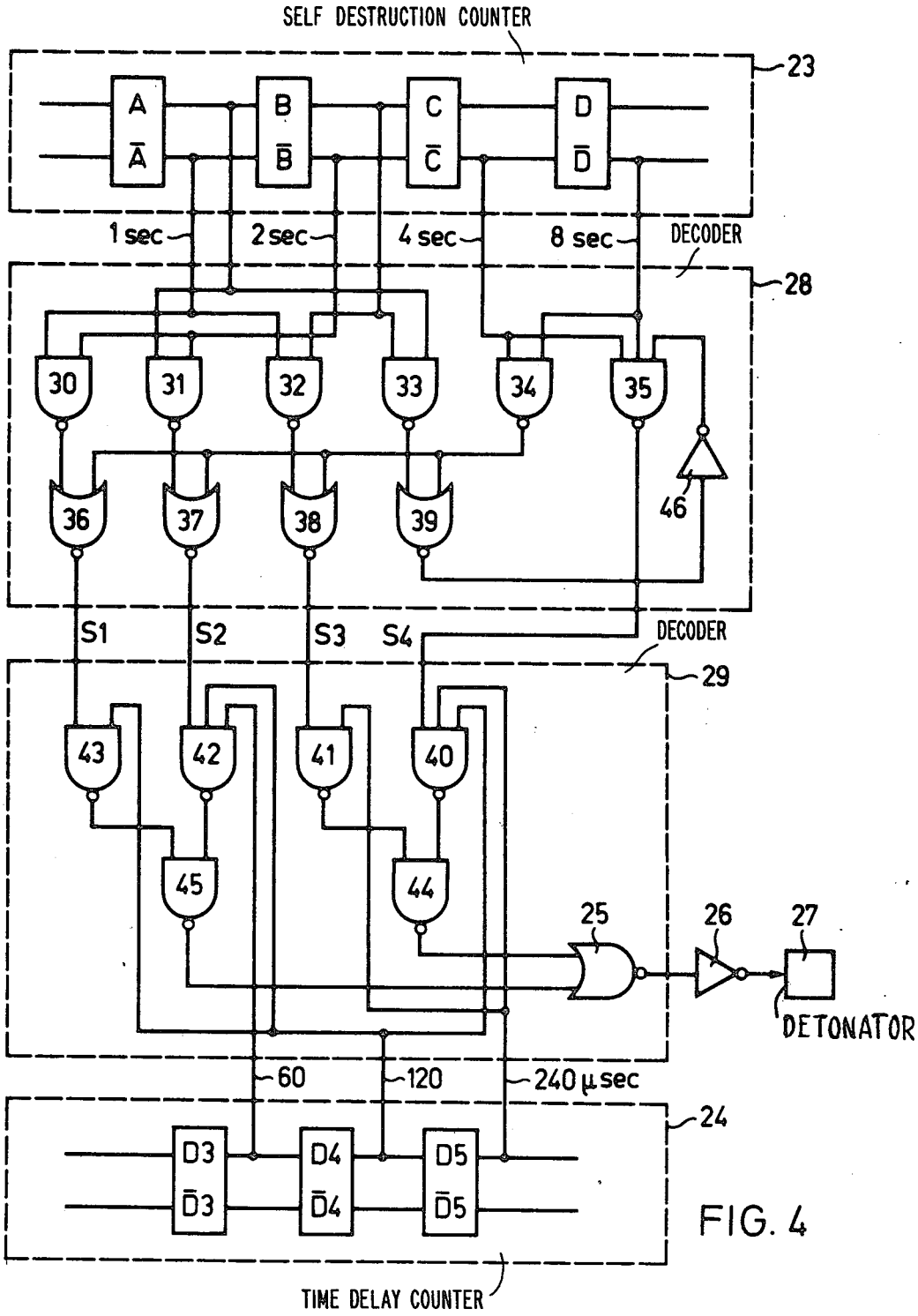
FIG. 4 is a block circuit diagram illustrating the construction of the counter and decoder illustrated in FIG. 2.

A conventional construction of impact fuze according to FIG. 1, see also Swiss Patent No. 608,604, is provided with an impact switch 10 and a blocking switch 11. The impact switch 10 is actuated upon impact of the projectile or the like at the target. The blocking switch 11 prevents premature actuation of the impact switch 10 during the projectile firing or launching phase and ensures for the usual firing barrel safety, i.e. that the projectile will not prematurely detonate in front of the launching or firing barrel. The two switches 10 and 11 are connected to each other by means of a NOR-gate 12 and the impact switch 10 is connected via this NOR-gate 12 to a flip-flop switch or circuit 15 which is composed of two NOR-gates 13 and 14. With the impact of the projectile or the like at the target the flip-flop switch 15 is switched-over by means of the response signal delivered by the impact switch 10. The flip-flop switch 15 is connected by means of an inverter 16 to an RC-oscillator 17 and via a NAND-gate 18 to a frequency doubler or frequency doubling circuit 19. Both the flip-flop switch 15 and the RC-oscillator 17 are connected by means of a counter input circuit 20 to a self-destruction counter 23. The counter input circuit 23 is composed of two NAND-gates 21 and 22. To the frequency doubler 19 there is connected a time-delay counter 24. Both the self-destruction counter 23 and the time-delay counter 24 are connected via a NOR-gate 25 and an inverter 26 to a detonation capsule or pellet 27 or equivalent structure.

The RC-oscillator 17 can be switched-over to selectively operate at two different pulse frequencies, for instance 250 Hz or 30 kHz. To the self-destruction counter 23 there is delivered a frequency of 250 Hz. To the time-delay counter 24 there is exclusively delivered by means of the frequency doubler 19 a pulse frequency of 60 kHz.

At this point there will be described in greater detail the mode of operation of this prior art impact fuze.

If a projectile or the like equipped with the aforedescribed impact fuze impinges upon a target, the flip-flop switch 15 is switched-over by means of the impact switch 10. At the same time, the self-destruction counter 23 is blocked and the RC-oscillator 17 is switched-over to the higher pulse frequency of 30 kHz. By means of the flip-flop switch 15 the time-delay counter 24 is switched-on and supplied by means of the frequency doubler 19 with a pulse frequency of 60 kHz. As soon as this time-delay counter 24 has decoded, for instance, 8 counting pulses, the detonation capsule 27 receives a current surge or pulse and detonates. This somewhat complicated solution was chosen for the following reasons:

(a) apart from the capacitor in the RC-oscillator 17, the circuit does not require an additional capacitor for the signal delay;

(b) the RC-oscillator 17 requires few external passive components;

(c) the temperature characteristics of the delay time are good;

(d) a digital setting or adjustment of the delay time is possible.

With this prior art impact fuze the time-delay is independent of the flight time. This disadvantage is avoided by means of the arrangement according to FIG. 2, wherein there are illustrated the means for a flight time-dependent time-delay.

According to the circuit configuration of FIG. 2 there are connected to the self-destruction counter 23 two decoders 28 and 29. The self-destruction counter 23 and the decoder 29 are connected by means of the NOR-gate 25 and the inverter 26 to the detonation capsule or pellet 27.

Since the velocity of the projectile or other flying object decreases with increasing flight time, the time-delay between the time of impact of the projectile at the target and the detonation of the projectile consequently would have to increase, so that even with a small velocity of the projectile the same can sufficiently penetrate into the target before the detonation occurs. The response delay of an electronic base or tail fuze essentially is independent of the target and constant. A time-delay of about 250 μsec initially is sufficient for enabling a projectile to first penetrate the target and thereafter detonate.

By referring to FIG. 3 and Table I set forth hereinafter there will be recognized this relationship between the flight time of the projectile and the required time-delay.

It is assumed that the initial velocity $v_o$ of the projectile amounts to $v_o = 1180$ m/sec and the projectile during the first second therefore covers a distance of about 1 km. During the first second there is thus required a time-delay of about 250 μsec. However, after the third second the projectile flies considerably slower and there is required a time-delay of about 460 μsec:

TABLE I

| flight time in sec. | time-delay in μsec total | time-delay in μsec electronic | circuit |
|---|---|---|---|
| 0–1 | 250 | 120 | S1 |
| 1–2 | 280 | 180 | S2 |
| 2–3 | 340 | 240 | S3 |
| 3–16 | 460 | 360 | S4 |

The time-delay of a base fuze is made up from the following parts:

(a) the travel time of the shock wave from the fuze tip to the tail of the projectile which amounts to about 40 to 50 μsec;

(b) the electronic time-delay which amounts to about 120 to 360 μsec; and (c) the pyrotechnical time-delay which amounts to about 50 to 60 μsec;

According to Table I, the total time-delay therefore can be selected so as to range from 250 to 460 μsec, wherein the number of steps is freely selectable. With the four steps according to the graph of FIG. 3 and Table I the circuit expenditure is tolerable and therefore will be explained hereinafter in greater detail.

The construction of the counters 23, 24 and the decoders 28, 29 illustrated in FIG. 2 will become evident by referring to FIG. 4.

According to FIG. 4 the self-destruction counter 23 is provided with a number of flip-flop stages, of which there are only illustrated the four stages $A\overline{A}$, $B\overline{B}$, $C\overline{C}$ and $D\overline{D}$. The time-delay counter 24 equally is provided with a number of flip-flop stages, of which there are only illustrated the three stages D3 $\overline{D}$3, D4 $\overline{D}$4 and D5 $\overline{D}$5. The decoder 28 is provided with a total of six NAND-gates 30, 31, 32, 33, 34 and 35, and four NOR-gates 36, 37, 38 and 39. The second decoder 29 is provided with a total of four NAND-gates 40, 41, 42 and 43 connected with the decoder 28 and the two further NAND-gates 44 and 45.

The four flip-flop stages of the self destruction counter 23 deliver the following signals:

| $D\overline{D}$ | $C\overline{C}$ | $B\overline{B}$ | $A\overline{A}$ | | seconds |
|---|---|---|---|---|---|
| 8 | 4 | 2 | 1 | | |
| 0 | 0 | 0 | 0 | S1 | 0–1 |
| 0 | 0 | 0 | L | S2 | 1–2 |
| 0 | 0 | L | 0 | S3 | 2–3 |
| 0 | 0 | L | L | S4 | 3–4 |
| 0 | L | 0 | 0 | S4 | 4–5 |
| 0 | L | 0 | L | S4 | 5–6 |
| 0 | L | L | 0 | S4 | 6–7 |
| 0 | L | L | L | S4 | 7–8 |
| L | 0 | 0 | 0 | S4 | 8–9 |

Therefore:

$$S1 = \overline{D} \cdot \overline{C} \cdot (\overline{B} \cdot \overline{A}) = \overline{\overline{\overline{D} \cdot \overline{C}} + \overline{\overline{B} \cdot \overline{A}}}$$

$$S2 = \overline{D} \cdot \overline{C} \cdot \overline{B} \cdot A = \overline{\overline{D} \cdot \overline{C} + \overline{B} \cdot A}$$

$$S3 = \overline{D} \cdot \overline{C} \cdot B \cdot \overline{A} = \overline{\overline{D} \cdot \overline{C} + B \cdot \overline{A}}$$

$$S4 = \overline{D} \cdot \overline{C} \cdot B \cdot A + \overline{D} \cdot C + D \cdot C + D \cdot \overline{C}$$

$$S4 = \overline{(\overline{D} \cdot \overline{C} + \overline{A \cdot B}) \cdot \overline{D} \cdot \overline{C}}$$

From this result the following connections at the decoder 28 according to FIG. 4:

(1) For S 1:

The NAND-gate 30 is connected to $\overline{A}$ and $\overline{B}$ of the flip-flop switches $A\overline{A}$ and $A\overline{B}$ of the self-destruction counter 23. The NOR-gate 36 is connected, on the one hand, to the output of the NAND-gate 30 and, on the other hand, via the NAND-gate 34 to $\overline{C}$ and $\overline{D}$ of the flip-flop switches $C\overline{C}$ and $D\overline{D}$. The output of the NOR-gate 36 delivers the signal S 1.

(2) For S 2:

The NAND-gate 31 is connected to A and $\overline{B}$ of the flip-flop switches $A\overline{A}$ and $B\overline{B}$ of the self-destruction counter 23. The NOR-gate 37 is connected, on the one hand, to the output of the NAND-gate 31 and, on the other hand, via NAND-gate 34 to $\overline{C}$ and $\overline{D}$ of the flip-flop switches $C\overline{C}$ and $D\overline{D}$. The output of the NOR-gate 37 delivers the signal S 2.

(3) For S 3:

The NAND-gate 32 is connected to $\overline{A}$ and B of the flip-flop switches $A\overline{A}$ and $B\overline{B}$ of the self-destruction counter 23. The NOR-gate 38 is connected, on the one hand, to the output of the NAND-gate 32 and, on the other hand, via the NAND-gate 34 to $\overline{C}$ and $\overline{D}$ of the flip-flop switches $C\overline{C}$ and $D\overline{D}$. The output of the NOR-gate 38 delivers the signal S 3.

(4) For S 4:

The NAND-gate 33 is connected to A and B of the flip-flop switches $A\overline{A}$ and $B\overline{B}$ of the self-destruction counter 23. The NOR-gate 39 is connected, on the one hand, to the output of the NAND-gate 33 and, on the other hand, via the NAND-gate 34 to $\overline{C}$ and $\overline{D}$ of the flip-flop switches $C\overline{C}$ and $D\overline{D}$. Furthermore, the NOR-gate 39 is connected via an inverter 46 to an input of the NAND-gate 35, and the other inputs of which are connected to $\overline{C}$ and $\overline{D}$ of the flip-flop switches $C\overline{C}$ and $D\overline{D}$. The output of the NAND-gate 35 delivers the signal S 4.

The flip-flop switches of the delay counter 29 deliver the following signals:

| D3 | D4 | D5 | time-delay μsec |
|---|---|---|---|
| L | 0 | 0 | 60 |
| 0 | L | 0 | 120 |
| L | L | 0 | 180 |
| 0 | 0 | L | 240 |
| 0 | L | L | 360 |

From this result the desired delay signals:

| signal | time-delay μsec |
|---|---|
| S1 · D4 | $\underline{\Delta}$ 120 |
| S2 · D3 · D4 | $\overline{\Delta}$ 180 |
| S3 · D5 | $\overline{\Delta}$ 240 |
| S4 · D4 · D5 | $\overline{\Delta}$ 360 |

Hence, there result the following connections at the decoder 29 according to FIG. 4:

For a time-delay of 120 μsec:

The NAND-gate 43 is connected to the NOR-gate 36 of the decoder 28 and to D4 of the flip-flop switch D4 $\overline{D4}$ of the delay counter 24.

For a time-delay of 180 μsec:

The NAND-gate 42 is connected to the NOR-gate 37 of the decoder 28 and to D3 and D4 of the flip-flop switches D3 $\overline{D3}$ and D4 $\overline{D4}$ of the delay counter 24.

For a time-delay of 240 μsec:

The NAND-gate 41 is connected to the NOR-gate 38 of the decoder 28 and to D5 of the flip-flop switch D5 $\overline{D5}$ of the delay counter 24.

For a time-delay of 360 μsec:

The NAND-gate 40 is connected to the NAND-gate 35 of the decoder 28 and to D4 and D5 of the flip-flop switches D4 $\overline{D4}$ and D5 $\overline{D5}$ of the delay counter 24.

Finally, as mentioned, the two NAND-gates 40 and 41 are connected to a NAND-gate 44 and the other two NAND-gates 42 and 43 to a further NAND-gate 45. These two NAND-gates 44 and 45 are connected by means of the NOR-gate 25 and the inverter 26 to the detonation capsule or pellet 27. For the self-destruction of the projectile or the like the self-destruction counter 23 is connected to the NOR-gate 25. Since the circuit according to FIG. 4 is a simple logical circuit, a more detailed description herein does not seem to be required.

At this point there will be explained the mode of operation of the aforedescribed impact fuze with flight time-dependent time-delay.

When firing a projectile or the like the RC-oscillator 17 depicted in FIG. 1 is switched-on and there arrive 250 pulses per second at the self-destruction counter 23. After the first second of flight time this self-destruction counter 23 generates the pulse S1, after the second second the pulse S2, after the third second the pulse S3 and after the fourth second the pulse S4. Furthermore, the self-destruction counter 23 generates at the desired moment in time a signal which causes the self-destruction of the projectile, if the same has not impacted upon the target prior thereto.

During the launching or firing phase and for the purpose of ensuring for the firing barrel safety the blocking or locking switch 11 prevents premature release of, for instance, a piezo switch.

If the projectile impacts at a target then the RC-oscillator 17 is switched-over from the low frequency of 250 Hz to the high frequency of 30 kHz by means of the impact switch 10. However, these pulses no longer arrive at the self-destruction counter 23, but via the frequency doubler 19 there are delivered 60,000 pulses per second to the time-delay counter 24.

If the impact of the projectile occurs before the first second has passed after the projectile has been launched, then the signal S1 is delivered to the decoder 29 at the moment of impact. As soon as the delay counter 24 has counted an interval of 120 μsec the decoder 29 receives a signal, which together with the signal S1 is capable of triggering the detonation capsule of pellet, i.e. causing the detonation thereof. If the impact occurs later, for instance before the second, third or fourth second has expired after launching or firing the projectile, then there is delivered to the decoder 29 at the moment of the projectile impact the signal S2, S3 or S4, respectively. As soon as the delay counter 24 has counted an interval of 180, 240 or 360 μsec, respectively, the decoder 29 receives a signal, which together with the corresponding signal S2, S3 or S4, respectively, is capable of triggering the detonation capsule or pellet 27, i.e. causing the detonation thereof.

While there are shown and described present preferred embodiments of the invention, it is to be distinctly understood that the invention is not limited thereto, but may be otherwise embodied and practiced within the scope of the following claims. ACCORDINGLY,

What I claim is:

1. An impact fuze for a flying object, especially for rockets or projectiles, with flight time-dependent time-delay between the moment of impact and the detonation of the rocket or the projectile, comprising:

means for measuring the flight time of the flying object;

means for measuring the time-delay between projectile impact at a target and projectile detonation;

means for adjusting said time-delay as a function of said flight time of the flying object;

said means for measuring the flight time comprising a first counter;

said means for measuring the time-delay comprising a second counter;

said adjusting means comprising a circuit for switching-over in stages said second counter to a greater time-delay as a function of said flight time determined by said first counter;

said stages being of unequal temporal magnitude; and said temporal magnitudes increasing as the flight time of the projectile increases.

2. An impact fuze for a flying object, especially for rockets or projectiles, with flight time-dependent time-delay between the moment of impact and the detonation of the rocket or the projectile, comprising:

means for measuring the flight time of the flying object;

means for measuring the time-delay between projectile impact at a target and projectile detonation;

means for adjusting said time-delay as a function of said flight time of the flying object;

said means for measuring the flight time comprising a first counter;

said means for measuring the time-delay comprising a second counter;

said adjusting means comprising a circuit for switching-over in stages said second counter to a greater time-delay as a function of said flight time determined by said first counter;

said circuit means comprise first and second decoders;

said first counter being connected via said first decoder to said second decoder;

said first counter being connected via a NOR-gate and an inverter to a detonation capsule; and said second decoder being connected via said NOR-gate and said inverter to said detonation capsule.

3. The impact fuze as defined in claim 2, wherein:

said first counter possesses a respective flip-flop switch for each second of time; and said second counter possesses a respective flip-flop switch for each of three different time-delays.

* * * * *